US005927019A

United States Patent [19]

Ichida

[11] Patent Number: 5,927,019

[45] Date of Patent: Jul. 27, 1999

[54] EARTHQUAKE-RESISTANT DOOR STRUCTURE AND AN EARTHQUAKE-RESISTANT DEVICE

[76] Inventor: Minoru Ichida, 6-14-29, Shimo-Shakujii, Nerima-ku, Tokyo, 177, Japan

[21] Appl. No.: 08/893,097

[22] Filed: Jul. 15, 1997

[30] Foreign Application Priority Data

| | | | |
|---|---|---|---|
| Jul. 16, 1996 | [JP] | Japan | 8-185879 |
| Dec. 27, 1996 | [JP] | Japan | 8-351128 |
| Jun. 24, 1997 | [JP] | Japan | 9-167246 |

[51] Int. Cl.[6] ..... E06B 3/00

[52] U.S. Cl. ..... 49/501; 52/167.1

[58] Field of Search ..... 49/501; 52/167.1

[56] References Cited

U.S. PATENT DOCUMENTS

| | | | |
|---|---|---|---|
| 4,503,640 | 3/1985 | Stern | 49/501 X |
| 4,850,145 | 7/1989 | McAfee | 49/501 |
| 4,960,150 | 10/1990 | Ryan | 49/127 X |

FOREIGN PATENT DOCUMENTS 61-32072 9/1986 Japan .

*Primary Examiner*—Jerry Redman
*Attorney, Agent, or Firm*—Nikaido, Marmelstein, Murray & Oram LLP

[57] ABSTRACT

Disclosed are improvements in earthquake-resistant devices and earthquake-resistant doors. An earthquake-resistant device according to the present invention comprises a stationary frame and a roll partly exposed from and rotatably fixed to the stationary frame. The earthquake-resistant device can be embedded and fixed to the upper or lower lateral side of the door with its roll permitted to rotate vertically, or can be embedded and fixed to the non-hinged longitudinal side of the door with its roll permitted to rotate horizontally. An earthquake-resistant door structure according to the present invention has one or more earthquake-resistant devices built therein, particularly in the upper, lateral side and the non-hinged, longitudinal side of the door, allowing their rolls to appear partly.

7 Claims, 8 Drawing Sheets

EARTHQUAKE-RESISTANT DOOR STRUCTURE AND AN EARTHQUAKE-RESISTANT DEVICE

BACKGROUND OF THE INVENTION

1. Field of the Invention

The present invention relates to an improvement in or relating to an earthquake-resistant door structure which can be opened even if the wall or door frame is deformed by a strong force applied thereto when an earthquake occurs or when a strong wind blows. Also, the present invention relates to an earthquake-resistant device which can be fixed to a door having 5 to 6 millimeter-wide clearances between the lateral or longitudinal side of the door and the corresponding lateral or longitudinal side of the surrounding door frame, no matter what type of lock the door may have fixed thereto, rim type or mortise type, assuring that the door can be opened no matter what extensive or localized deformation may be caused in the wall or surrounding door frame.

2. Description of Related Art

When a strong earthquake occurs, buildings are broken or so badly deformed that doors could not open to confine people in rooms. People will be panic-stricken, and sometimes people can not leave closed rooms, getting involved in fires or collapse when happening subsequent to the earthquake as a secondary disaster. Therefore, there has been an ever increasing demand for earthquake-resistant door, which have means to assure the opening of the door even if the door frames are badly deformed as a result of earthquake.

Kobe district was stricken by such a great earthquake that nobody had experienced before (called "the Great Earthquake in the Hanshin District"), and people have learnt that doors should be so resistant to earthquake as to permit people to open the doors even if the door frames are badly deformed. Earthquake-resistant doors are assured to be reliable if they pass the performance test of doors (particularly, the resistance-to-diagonal deformation test under static load, and resistance-to-localized deformation test under static load) according to the residential articles checking guidance which was officially prescribed in July, 1996.

There are two kinds of locks commonly used in middle- or high-storied apartment houses, that is, rim type locks and mortise type locks. No matter which type of locks may be used, however, it may be possible that locks cannot be opened without being fixed to such earthquake-resistant doors as meet prescriptions both of resistance to diagonal deformation and resistance to localized deformation.

Japanese Utility Model 61-32072(B) shows such an earthquake-resistant door structure. Referring to FIG. 16, an earthquake-proof device comprises a two-rolled assembly 20 and a right-angled piece 21. The two-rolled assembly 20 has vertical and horizontal rolls 22 and 23 journaled by its bearing projections, and the right-angled piece 21 is chamfered on one lateral-and-longitudinal side. The two-rolled assembly 20 is fixed to the upper corner of the door on its rear side, and the right-angled piece 21 is fixed to the corresponding upper corner of the door frame with the chamfered edge directed outward. When the door is closed, the vertical and horizontal rolls 22 and 23 of the two-rolled assembly 20 are apart more or less from the lateral and longitudinal flat planes 24 of the right-angled piece 21. The vertical and/or horizontal rolls, however, are allowed to roll on the flat-and-slants of the lateral-and-vertical sections of the right-angled piece 21 only when the door is tilted in the door frame as a result of earthquake, thus permitting the door to be opened automatically.

Advantageously this earthquake-proof device can be fixed to not only a new door but also an existing door. The earthquake-proof device, however, need to be fixed to the door within a minimum allowance; if not, the door cannot be opened. Therefore, the fixing of such earthquake-proof devices to existing doors must rely on artisans, skillfulness.

Also, disadvantageously the earthquake-proof device when fixed to the door will spoil the pleasing appearance of the door. The door having such an earthquake-proof device is liable to give a negative impression of the door being defective more or less (the door appearing to be incomplete by itself unless such an extra device is attached), thus lowering the commercial quality.

Further, according to a recent commercialized earthquake-resistant door structure which has cleared said newly prescribed earthquake-resistant performance test, a gap of 13 mm is provided between the shutting style side end of the door body and the door frame. However, disadvantageously such a door structure requires extra parts such as dust- or wind-proof strips to cover the gap.

SUMMARY OF THE INVENTION

In view of the above one object of the present invention is to provide an earthquake-resistant door structure permitting the door to be opened in case of extensive or localized deformation, which may be caused by earthquakes, thus assuring that people are safe from the confinement within closed rooms or fires which may be caused subsequent to the earthquake as a secondary disaster.

Another object of the present invention is to provide an earthquake-proof device which can be easily fixed to the door without spoiling its pleasing appearance, permitting the door to be opened in case of extensive or localized deformation, which may be caused by earthquakes, thus assuring that people are safe from the confinement within closed rooms or fires as the secondary disaster.

Still another object of the present invention is to provide an earthquake-proof device which can be fixed to the door, leaving a 5 to 6 millimeter-wide gap between the door and the surrounding door frame no matter which type of locks may be used, rim type locks and mortise type locks.

To attain these objects an earthquake-resistant door structure according to the present invention has one or more earthquake-resistant devices built therein, each having a roll rotatably fixed to and partly exposed from its stationary frame. The fixing of the earthquake-resistant devices to the door causes no deterioration of pleasing appearance of the door, allowing only their rolls to appear partly out of sight.

Each of said earthquake-resistant devices may be embedded in the upper corner end and/or in the non-hinged longitudinal side of the door with the roll partly exposed therefrom. Deformation of the wall and surrounding door frame will cause the rolls of the earthquake-resistant devices to be pushed against the surrounding door frame, thereby putting the door in the slipping-and-opening condition.

The earthquake-resistant device may be embedded in the upper corner end of the door so as to permit its roll to rotate vertically, and the earthquake-resistant device may be embedded in the non-hinged longitudinal side of the door so as to permit its roll to rotate horizontally.

The earthquake-resistant device may comprise a stationary frame and a roll partly exposed from and rotatably fixed to the stationary frame, thereby permitting the device to be embedded in the upper or non-hinged longitudinal side of the door with its roll partly exposed therefrom.

The earthquake-resistant device can be embedded and fixed to the upper or lower lateral side of the door with its roll permitted to rotate vertically, or can be embedded and fixed to the non-hinged longitudinal side of the door with its roll permitted to rotate horizontally.

The earthquake-resistant device may be embedded and fixed to the upper lateral side of the door with its roll permitted to rotate vertically, and wherein it may be embedded and fixed to the non-hinged longitudinal side of the door with its roll permitted to rotate horizontally.

With these arrangements each earthquake-resistant device can be easily fixed in right position by putting it coplanar with the lateral or longitudinal side of the door, allowing the roll to be exposed in the narrow gap between the lateral or longitudinal side of the door and the surrounding door frame.

Also, it is assured that either earthquake-resistant device is pushed against the longitudinal or lateral side of the surrounding door frame, depending on which direction the wall or surrounding door frame is deformed upon occurrence of the earthquake.

The earthquake-resistant device may be embedded and fixed to the upper corner end of the door with its roll permitted to rotate vertically, and it may be embedded and fixed to the non-hinged longitudinal side of the door at the intermediate position between the upper corner end and the position at which a door handle or lock is fixed to the door, permitting its roll to rotate horizontally. Such arrangement of earthquake-resistant devices in the door makes the door effectively resistant both to the extensive deformation and localized deformation.

The earthquake-resistant device may further comprise a roll abutment to be fixed to the surrounding door frame in opposing relation with the roll. The roll abutment thus fixed to the surrounding door frame has the effect of preventing the roll from being put in ineffective position, which roll, otherwise, would be inoperative if the surrounding door frame is deformed at the roll-confronting portion.

The roll abutment may comprise a guide plane inclined in the direction in which the roll leaves the roll abutment when the door is opened. The inclined guide plane has the effect of expediting the releasing of the roll from the surrounding door frame when an earthquake occurs.

The guide plane may have different angles in longitudinal and lateral directions, thereby permitting the door to be most effectively opened no matter in which directions the door may be deformed.

Other objects and advantages of the present invention will be understood from the following description of earthquake-resistant devices and earthquake-resistant doors according to preferred embodiments of the present invention, which are shown in accompanying drawings.

DESCRIPTION OF THE PREFERRED EMBODIMENTS

Figure 1:
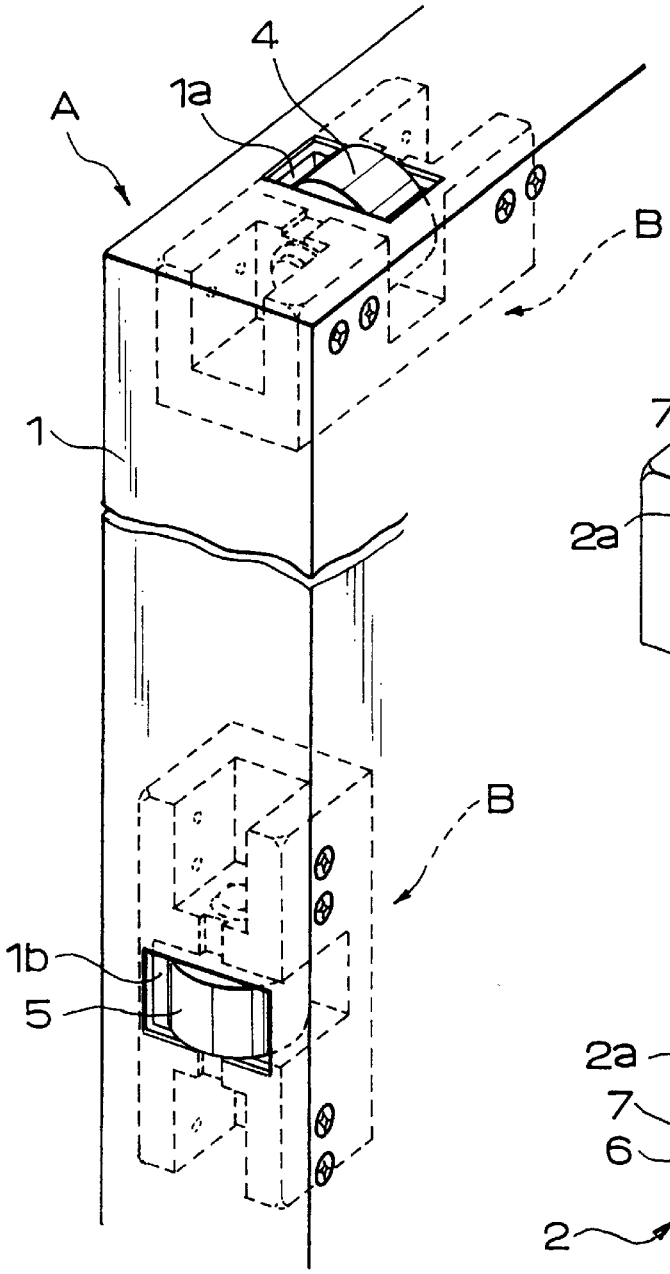
FIG. 1 is a perspective view of an earthquake-resistant door according to the present invention.

Referring to FIG. 1, an earthquake-resistant door structure A according to one embodiment of the present invention has a pair of earthquake-resistant devices B built in the upper lateral and non-hinged longitudinal sides of the door body 1. As seen from the drawing, the roll 4 or 5 of each earthquake-resistant device B is partly exposed from the roll slot 1*a* or 1*b* of the upper lateral or non-hinged longitudinal side of the door frame.

Figure 2:
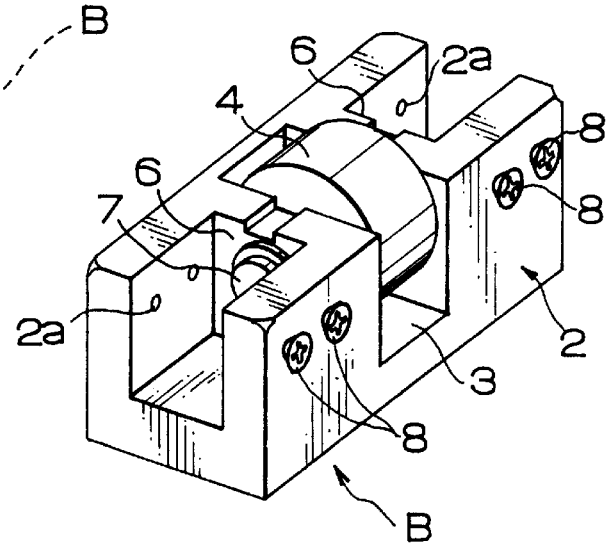
FIG. 2 is a perspective view of an earthquake-resistant device according to one embodiment of the present invention, showing the device in lying position in which its roll can rotate vertically.
Figure 3:
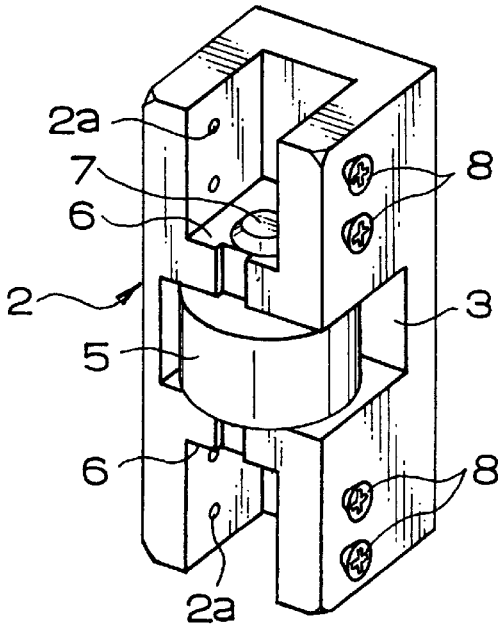
FIG. 3 is a perspective view of the earthquake-resistant device in upstanding position in which its roll can rotate horizontally.
Figure 4A:
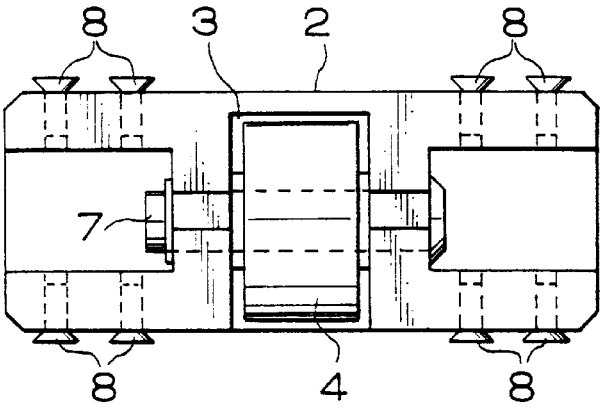
FIGS. 4*a*, 4*b* and 4*c* are plane, front and side views of the earthquake-resistant device.
Figure 4C:
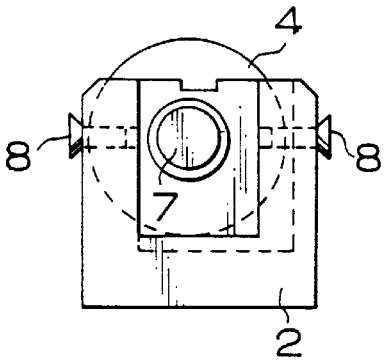
Figure 4B:
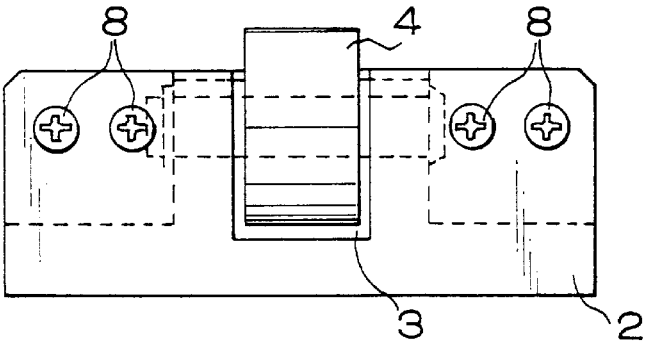
Figure 5:
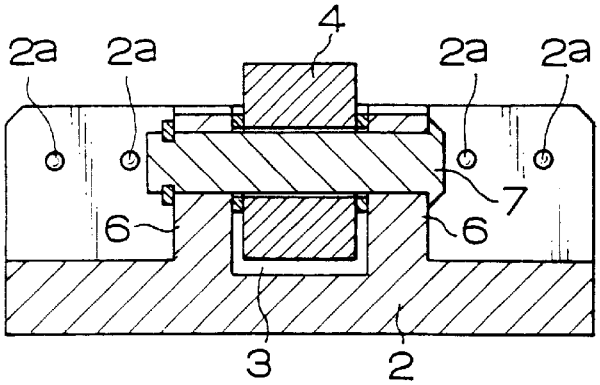
FIG. 5 is a longitudinal section of the earthquake-resistant device.

Referring to FIGS. 2 to 4, the earthquake-resistant device B comprises a recessed rectangular solid body 2 having two opposite longitudinal recesses opening outward and an intermediate recess 3 opening sideward, and a roll 4 or 5 rotatably fixed to the opposite walls 6, which define the longitudinal recesses on their closing sides. The roll which is permitted to rotate vertically by putting the earthquake-proof device B in horizontal position (see FIG. 2), is indicated by the reference numeral 4 whereas the roll which is permitted to rotate horizontally by putting the earthquake-proof device B in vertical position (see FIG. 3), is indicated by the reference numeral 5.

The recessed rectangular solid body 2 is made of a rigid material such as stainless steel, and its size depends on the thickness of the door. One example of the size is 77 mm×30 mm×30 mm.

As for the roll it is rotatably fixed to the opposite walls 6 of the intermediate recess 3 by inserting its axle 7 therein, exposing the roll partly from the top of the rectangular body 2.

The manner in which the earthquake-proof device B is fixed to the door body 1 is described below.

The earthquake-proof devices B are put in the upper lateral and non-hinged longitudinal sides of the door body 1 with their rolls 4 and 5 fitted in the roll slots 1*a* and 1*b* of the upper lateral and non-hinged longitudinal sides of the door body 1, and the earthquake-proof devices B are fixed to the door body 1 by driving screws 8 in the tapped holes 2*a* of the rectangular solid bodies 2. Thereafter, finish plates (not shown) are applied to the opposite sides of the door body 1, thereby concealing the heads of the screws 8.

Figure 9:
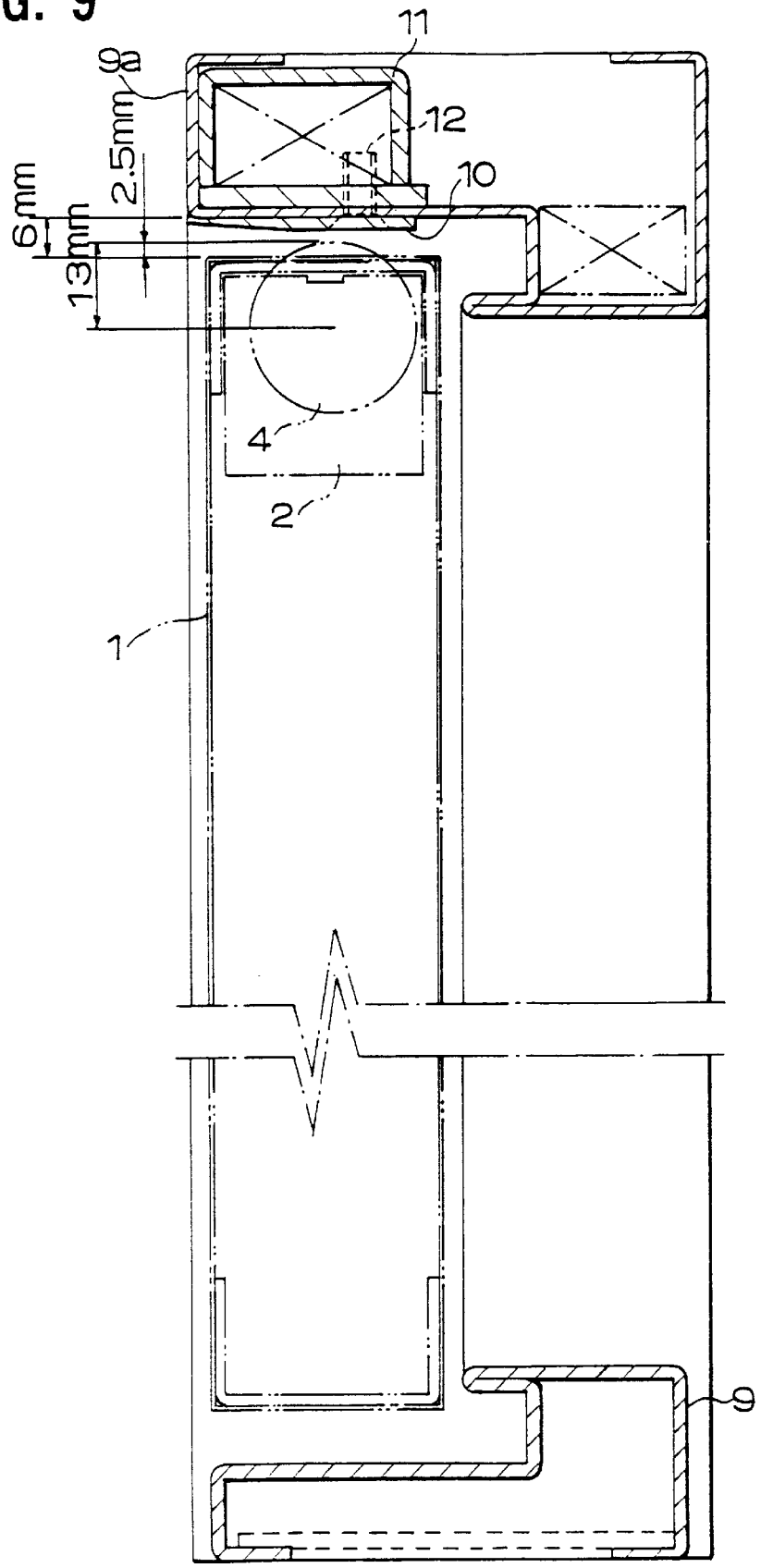
FIG. 9 shows, in section, how the roll of the earthquake-resistant device opposes the confronting area of the upper lateral side of the surrounding frame, leaving the clearance therebetween.
Figure 10:
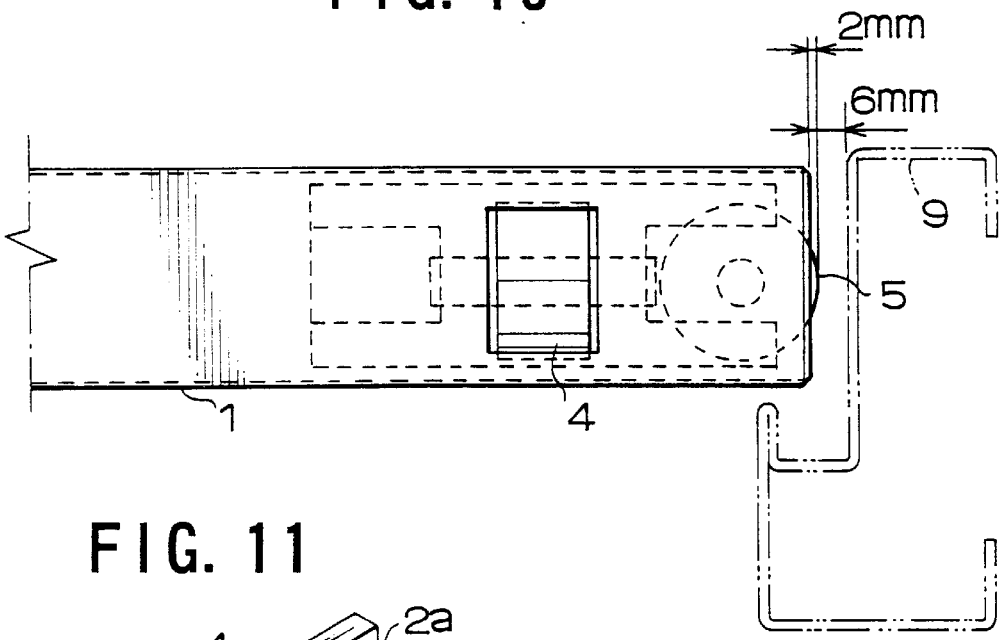
FIG. 10 shows, in section, how the roll of the earthquake-resistant device opposes the confronting area of the non-hinged longitudinal side of the surrounding door frame, leaving the clearance therebetween.
Figure 11:
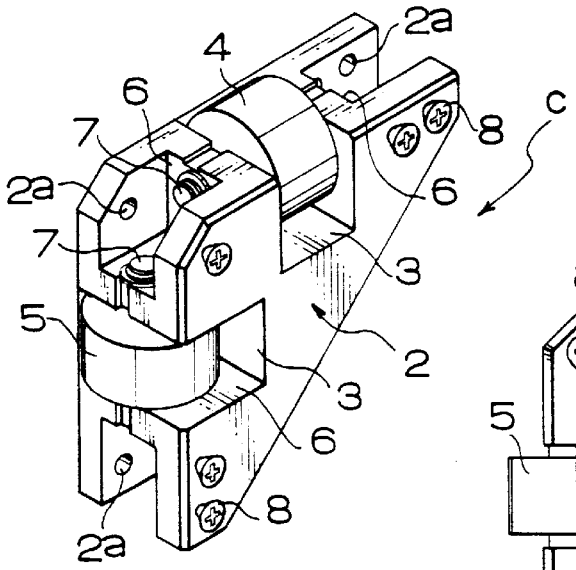
FIG. 11 is a perspective view of an earthquake-resistant device according to another embodiment of the present invention.
Figure 12A:
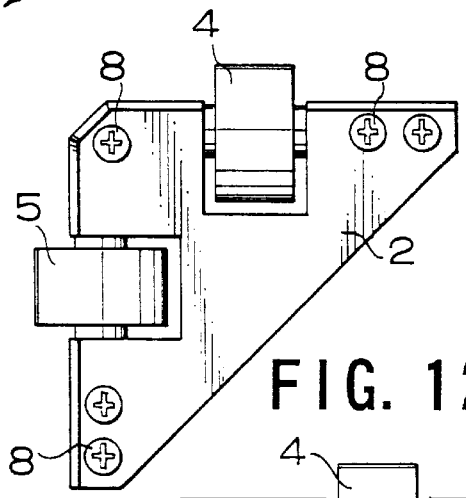
FIGS. 12*a* and 12*b* are front and rear views of the earthquake-resistant device.
Figure 12B:
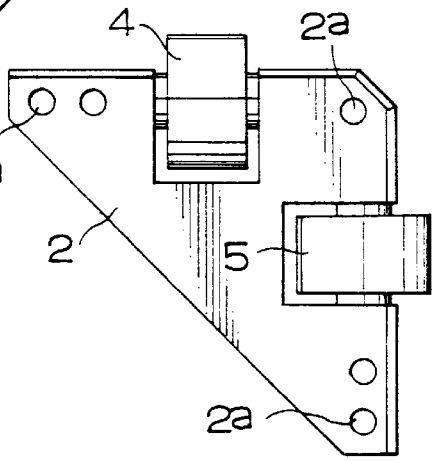
Figure 13A:
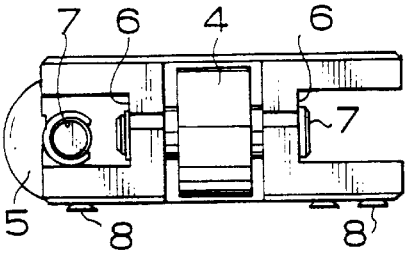
FIGS. 13*a*, 13*b*, 13*c* and 13*d* are top, bottom, left side and right side views of the earthquake-resistant device.
Figure 13B:
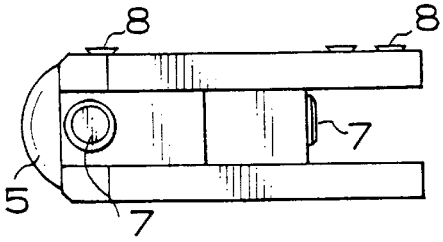
Figure 13C:
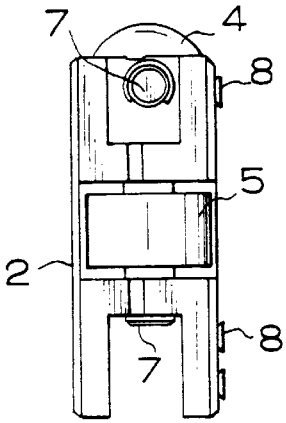
Figure 13D:
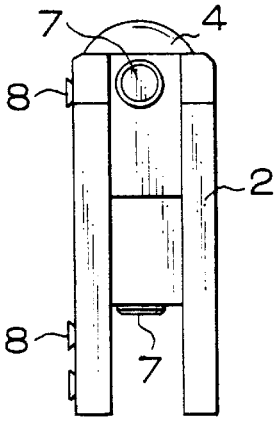
Figure 14:
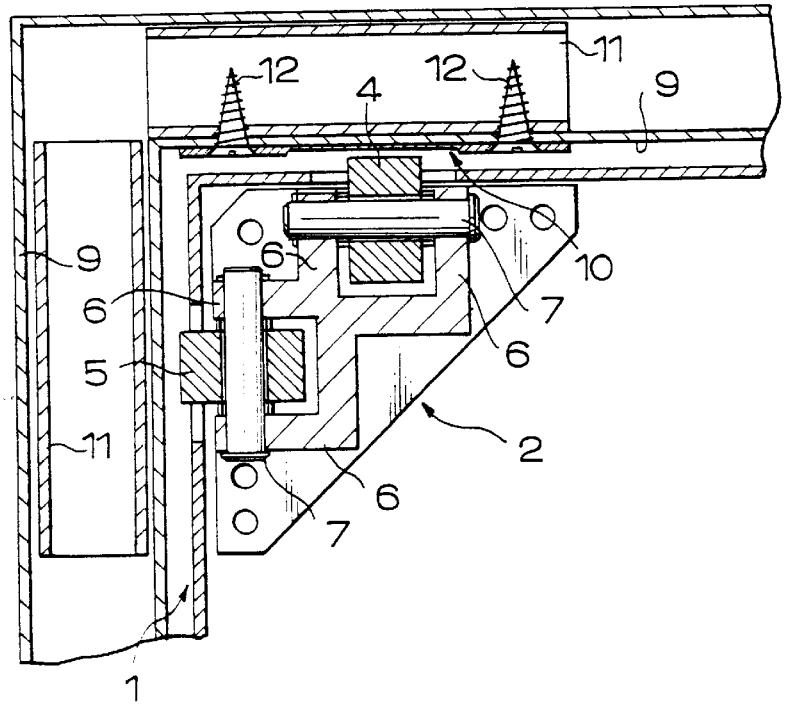
FIG. 14 shows, in section, how the earthquake-resistant device is fixed to the door corner and the confronting area of the surrounding door frame.

The vertically rotating roll 4 is exposed about 1.5 to about 2.5 mm high above the upper lateral side of the door body 1 (see FIG. 9) whereas the horizontally rotating roll 5 is exposed about 2 to about 3 mm high above the non-hinged longitudinal side of the door body 1 (see FIG. 10).

Figure 6:
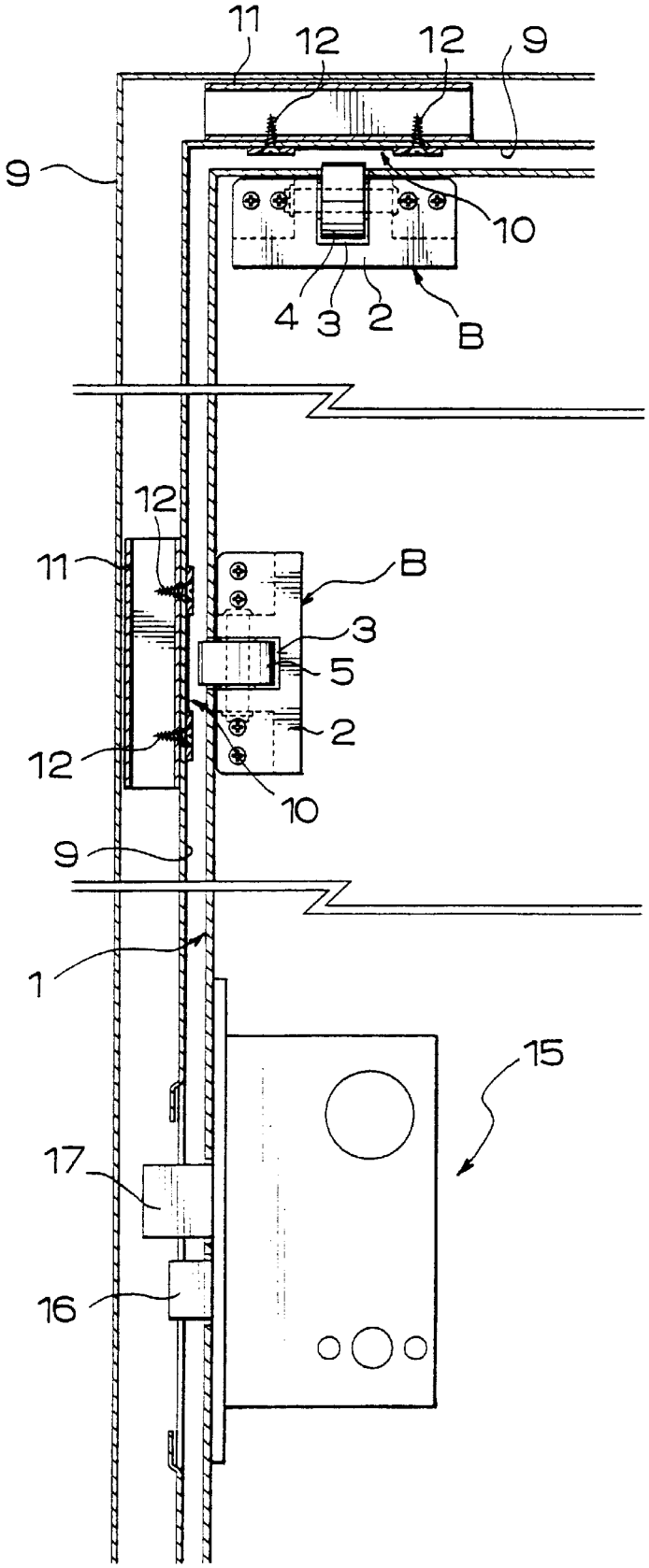
FIG. 6 is a longitudinal section of the earthquake-resistant door, showing how the earthquake-resistant devices are fixed to the door structure.
Figure 7A:
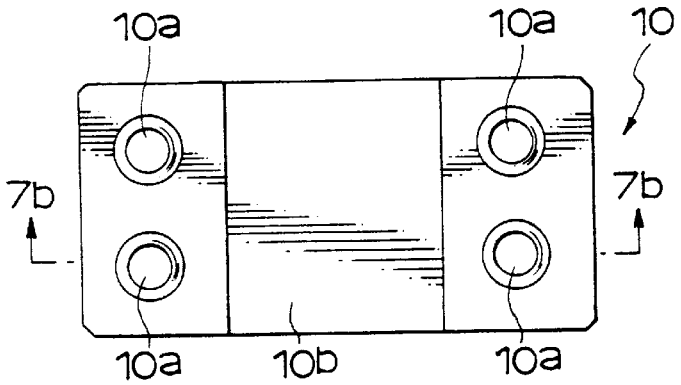
FIGS. 7*a*, 7*b* and 7*c* are plane, longitudinal section and perspective views of a roll abutment.
Figure 7B:
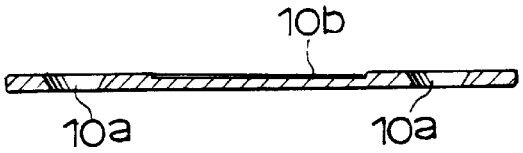

Referring to FIG. 6, a roll abutment 10 is fixed to the surrounding door frame 9 in confronting relation with the roll 4 or 5 of each earthquake-proof device B. The roll abutment 10 is rectangular in shape, and is made of stainless steel. As seen from FIG. 7, the roll abutment 10 has holes 10*a* made at its corners, and a depressed guide plane 10*b* inclined in the direction in which the roll 4 or 5 leaves the roll abutment 10 when the door is opened. In FIG. 6 a mortise lock is indicated by 15, a dead bolt by 16, and a latch bolt by 17.

Figure 7C:
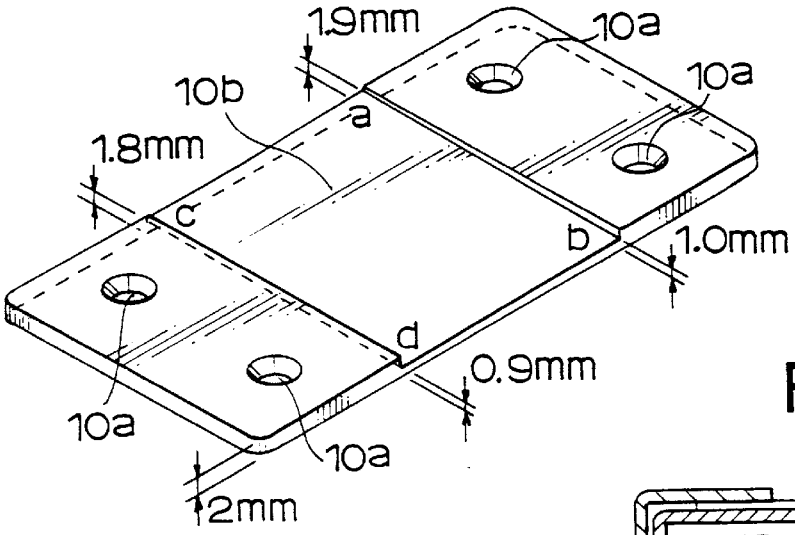

An inclined plane 10*b* of the roll abutment 10 has a function to guide the abutting roll 4 in door opening direction. Its angle of inclination may be set as a single-slope in constant gradient, or may be set as a double-slope wherein the angle of inclination is different in both of longitudinal and width directions of the roll abutment 10. An example of the double-slope type inclined plane is shown in FIG. 7*c*. Namely, a two millimeter-thick plate is so depressed in its intermediate area that the plate thickness may be reduced to be: 1.9 mm at Point a; 1.0 mm at Point b; 1.8 mm at Point c and 0.9 mm at Point d, thus forming a gradient of 0.1 millimeter in a longitudinal distance from Point a to Point c, and a gradient of 0.9 millimeter in a lateral distance from Point a to Point b.

Figure 8:
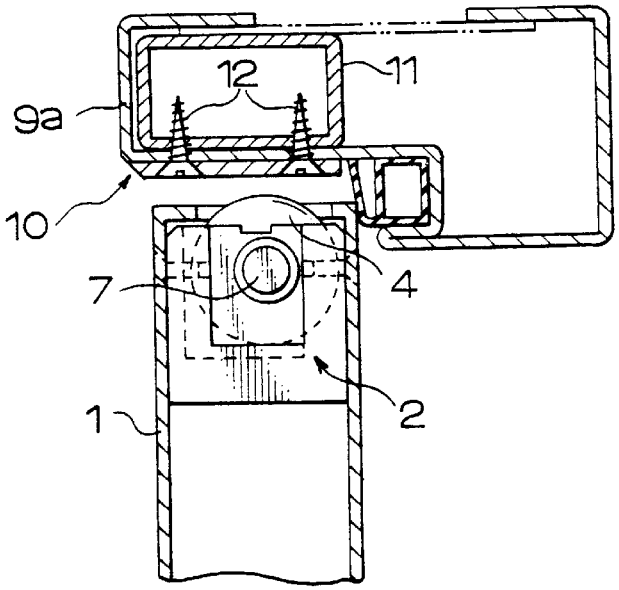
FIG. 8 shows, in section, how the earthquake-resistant device is fixed to the door and the confronting area of the surrounding door frame.

Referring to FIGS. 8 and 9, a reinforcement member 11 is put in the upper lateral side 9*a* of the door frame, and the roll abutment 10 is fixed to the reinforcement member 11 by driving screws 12 both through the upper lateral side 9*a* and the underlying reinforcement member 11. The reinforcement member 11 has the effect of preventing deformation of the upper lateral side 9*a* of the door frame which otherwise, would be caused by localized force when an earthquake occurs, and at the same time, in-creasing the force with which the door is released at the instant the upper lateral side 9*a* of the door frame is deformed.

The slope of the guide plane of the abutment 10 is at different gradients both in the lateral and longitudinal directions, thereby permitting the sure, smooth opening of the door no matter in which direction the deformation may be caused, thereby assuring that the door is ready to open for emergencies.

The fixing of such earthquake-proof devices require only a small clearance (5 to 6 millimeter wide) between the lateral or non-hinged longitudinal side of the door body and the surrounding door frame, compared with the clearance (8 to 13 millimeter wide) which the conventional earthquake-proof device requires in fixing.

When an earthquake occurs, the vertically rotating roll 4 and/or the horizontally rotating roll 5 will be pushed against the lateral side or non-hinged longitudinal side of the door frame, producing counter forces resistant to further deformation, and permitting the door body 1 to slip out from the surrounding door frame if it continues to be deformed beyond a certain limit.

The earthquake-proof device B can be embedded and fixed to the non-hinged longitudinal side of the door at the intermediate position between the upper corner end and the position at which a door handle (or latch bolt of the lock) is fixed to the door body, thus permitting a substantial resistance to not only extensive deformation but also localized deformation even in case that a mortise lock is used. Because the existence of the horizontally rotating roll 5 suppresses effectively the load on the mortise lock, thereby preventing significant localized deformation so that the door handle may be permitted to rotate. Thus, the situation can be avoided in which the mortise lock is so badly deformed as to prevent the unlocking and opening of the door.

This can be proved from the results of the tests on the resistance to the diagonal deformation and localized deformation, which test results show that the door releasing forces remain within permissible range (see Tables 2 to 4).

Referring to FIGS. 11 to 14, an earthquake-resistant device C according to a second embodiment of the present invention comprises a triangular solid body 2 having two rolls 4 and 5 rotatably fitted in its recesses 3 and 6 in the two orthogonal sides of the triangle.

The triangular body 2 is made of a rigid material such as stainless steel, and its size depends on the thickness of the door body 1, as for instance, each of two orthogonal sides is 75 mm long, and the door is 30 millimeters thick.

As shown in these drawings, the vertically rotating roll 4 is rotatably fixed to the recess 3 made in the lateral side of the triangle whereas the horizontally rotating roll 5 is rotatably fixed to the recess 3 made in the longitudinal side of the triangle.

Specifically, the triangular body 2 has a slotted round corner at its right angle, and two rolls 4 and 5 journaled by the traverse walls each defined between the corner slot and the recess 3 as indicated by 7. Preferably the vertically rotating roll 4 is 1.5 to 2.5 millimeters apart from the lateral side of the surrounding door frame whereas the horizontally rotating roll 5 is 2 to 3 millimeters apart from the longitudinal side of the surrounding door frame.

Even if the roll axle should be slipped off from the bearings, the roll and associated fixing parts are retained in the recess 3, not allowing them to fall in the space between the opposite plates of the door body 1.

Such a triangular-shaped earthquake-proof device can be easily fixed to the door body in right position simply by putting the triangular shape to be in conformity with the upper corner of the door body, and by driving screws 8 in the screw holes of the device.

The stainless steel body of the device has the effect of increasing the resistance to localized deformation at the corner of the door body 1.

The embodiments described above should not be understood to limit the present invention because various alterations and modifications can be made to such embodiments without departing from the spirit of the present invention, and therefore, such alterations and modification fall within the scope of the present invention.

For examples, the earthquake-proof devices are described as using a partly machined stainless steel body, but it can be a die-casting or can be made of any other rigid material selected from the point of economical view. The earthquake-proof devices B and C can have a hollow cubic body to reduce the weight of the device. The earthquake-resistant door A is described as having earthquake-proof devices fixed to the upper corner and non-hinged longitudinal side of the door body 1, but the door can have additional earthquake-proof devices fixed, for example to its lower corner.

Figure 15:
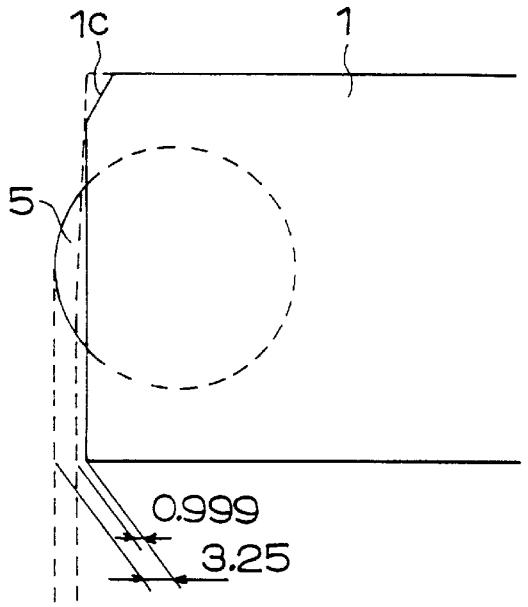
FIG. 15 shows what trace the earthquake-resistant door follows.
Figure 16:
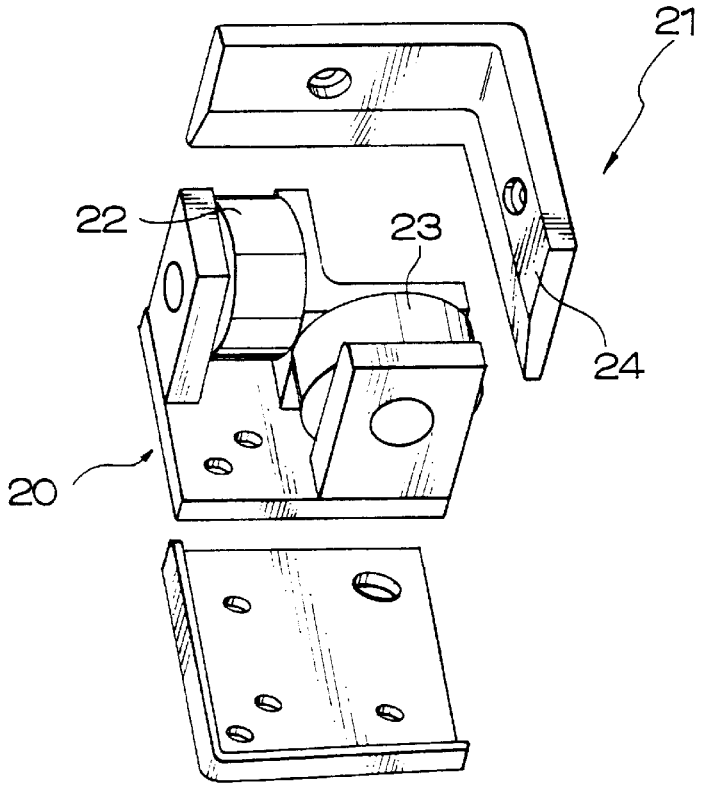
FIG. 16 PRIOR ART
FIG. 16 is a perspective view of a conventional earthquake-resistant door.

Referring to FIG. 15, the rear edge 1*c* of the non-hinged side of the door body 1 may be chamfered to assure that the door can be opened without being caught by the surrounding door frame. For example, the chamfered edge is sized to be 3 mm (rear side)×5 mm (non-hinged side) for a 800 millimeter-wide and 40 millimeter-thick door body.

The earthquake-resistant devices according to the above described embodiments B and C were fixed to steel doors (commercially available from "Sanwa Shutter", hereinafter referred to as "BL-Door"), and the earthquake-resistant BL-Doors were tested for their behaviors and resistibilities for the extensive and localized deformations according to the performance tests of residential articles, particularly front doors prescribed in July, 1996 (see Table 1). The tests were performed by a public corporation, the "For Better Living, Tukuba Architectural Products Testing Center", located at 2, Tachihara, Tukuba-shi, Ibaragi-ken, on Jun. 6, 1997. The test items and the testing methods are shown in Table 1, and the results of the tests are shown in Tables 2 to 4.

The test titled "Diagonal Deformation Test Under Static Load" is conducted for the purpose of determining the degree of door-opening difficulty of the post diagonal deformation. Specifically the test was performed by determining the unlatching torque and opening force while the door was subjected to the diagonal deformation. It is prescribed that the opening force be 200N or less for diagonal deformation of ±1/200, and 500N or less for diagonal deformation of ±1/120.

The test titled "Localized Deformation Test Under Static Load" is conducted for the purpose of determining the degree of door-opening difficulty of the post localized deformation. Specifically the test was performed by determining the unlatching torque and opening force while the door was subjected to the localized deformation, specifically the door being deformed at the middle of non-hinged longitudinal side and at the middle of the upper, lateral side. It is prescribed that the opening force be 500N or less for the middle displacement of 8 mm (non-hinged longitudinal side), and 500N or less for the middle displacement of 4 mm (upper, lateral side).

These tests are officially prescribed in Japan Industry Standards (JIS A 1521-1988, Test No.TSD-05, JIS A 1521-1996, Test No.TSD-06), and are widely accepted as earthproof standard.

The door opening force was determined in unit of 10N (1 kgf), and each door under test was a door having hinges on one longitudinal side (JIS A 1521-1996); such single-opened doors are commonly used in houses and flats or apartments, which are living spaces for people to be present upon the occurrence of an earthquake as assumed in the guidance of the architecture institute.

Dual-opened doors (or double-hinged doors) can be opened much easier than single-opened doors when deformed upon the occurrence of an earthquake. Therefore, it practically suffices that only single-opened doors are tested.

Results of the Tests:

The earthquake-resistant doors according to the present invention satisfied all requirements for diagonal and localized deformations as seen from Tables 2 to 4. Specifically the maximum values of door-opening force are 40N for diagonal deformations of 1/400, 1/300 and 1/200 (see Table 2), and the maximum values of door-opening force are 183N or less for diagonal deformations of 1/150 and 1/120 (see Table 3). These are below the door-opening force for diagonal deformations as prescribed (200N or less: 1/200 and 500N or less: 1/120). The door-opening force for localized deformation is 346N or less (the door-opening force being 500N or less as prescribed), as seen from Table 4 (Certified Test Results No.971240).

The values of diagonal deformations R appearing in Tables 2 and 3 are determined by the following equation:

$$R=(\delta 1-\delta 2)/H-(\delta 4-\delta 3)/L$$

where δ1: horizontal displacement (mm) of horizontal measurement reference point "a"e;

δ2: horizontal displacement (mm) of horizontal measurement reference point "b";

δ3: vertical displacement (mm) of vertical measurement reference point "c";

δ4: vertical displacement (mm) of vertical measurement reference point "d";

H: vertical distance between measurement reference points "a" and "b"=2055 mm; and L: horizontal distance between measurement reference points "c" and "d"=905 mm.

TABLE 1

Test Items and Testing Methods

| | performance test items | identity nos. of BL-door tests |
|---|---|---|
| 1 | diagonal deformation test under static load | TSD-05 |
| 2 | localized deformation test under static load | TSD-06 |

TABLE 2

Results of the Diagonal Deformation Test

| diagonal deformation R | number of times | sign | torque (J) thumb turn | torque (J) lever handle | opening force, max. (N) |
|---|---|---|---|---|---|
| initial values | | | 0.9 | 1.0 | 40 |
| 1/400 | 1 | + | 0.9 | 1.0 | 40 |
| | | − | 0.9 | 1.0 | 40 |
| | 2 | + | — | — | — |
| | | − | — | — | — |
| | 3 | + | 0.9 | 1.0 | 40 |
| | | − | 0.9 | 1.0 | 40 |
| 1/300 | 1 | + | 0.9 | 1.0 | 40 |
| | | − | 0.9 | 1.0 | 40 |
| | 2 | + | — | — | — |
| | | − | — | — | — |
| | 3 | + | 0.9 | 1.0 | 40 |
| | | − | 0.9 | 1.0 | 40 |

R = 1/400 ≈ 5.1 mm
1/300 ≈ 6.9 mm

TABLE 3

Results of the Diagonal Deformation Test

| diagonal deformation R | number of times | sign | torque (J) thumb turn | torque (J) lever handle | opening force, max. (N) |
|---|---|---|---|---|---|
| initial values | | | 0.9 | 1.0 | 40 |
| 1/200 | 1 | + | 0.9 | 1.0 | 40 |
| | | − | 0.9 | 1.0 | 40 |
| | 2 | + | — | — | — |
| | | − | — | — | — |
| | 3 | + | 0.9 | 1.0 | 40 |
| | | − | 0.9 | 1.0 | 40 |
| 1/150 | 1 | + | 0.9 | 1.0 | 46 |
| | | − | 0.9 | 1.0 | 181 |
| | 2 | + | — | — | — |
| | | − | — | — | — |
| | 3 | + | 0.9 | 1.0 | 43 |
| | | − | 0.9 | 1.0 | 155 |
| 1/120 | 1 | + | 0.9 | 1.0 | 183 |
| | | − | 0.9 | 1.0 | 143 |
| | 2 | + | — | — | — |
| | | − | — | — | — |
| | 3 | + | 0.9 | 1.0 | 180 |
| | | − | 0.9 | 1.0 | 143 |

R = 1/200 ≈ 10.3 mm (prescribed opening force: 200 N or less)
1/150 ≈ 13.7 mm
1/120 ≈ 17.1 mm (prescribed opening force: 500 N or less)

TABLE 4

Results of the Localized Deformation Test

| localized | torque (J) thumb turn | torque (J) lever handle | opening force, max. (N) |
|---|---|---|---|
| initial values | 0.9 | 1.0 | 40 |
| hor. direc. 8 mm | 0.9 | 1.0 | 346 |
| ver. direc. 4 mm | 0.9 | 1.0 | 40 |

prescribed opening force: 500 N or less

What is claimed is:

1. An earthquake-resistant door structure comprising a door having a door body, a stationary door frame, and at least one earthquake-resistant device, each device having a device body mounted inside said door body, at least one roll rotatably fixed to the device body and partly exposed from said door body, and a roll abutment to be fixed to the stationary frame in opposing relation with the at least one roll, wherein said roll abutment comprises a guide plane inclined in longitudinal and lateral directions in which the at least one roll leaves the roll abutment when the door is opened.

2. An earthquake-resistant door structure according to claim 1 wherein said door has an upper corner end and a non-hinged side, and each of said earthquake-resistant devices is embedded in at least one of the upper corner end and the non-hinged side of the door with the roll partly exposed therefrom.

3. An earthquake-resistant device to be fixed to a door comprising a stationary frame, at least one roll partly exposed from and rotatably fixed to the stationary frame, and a roll abutment to be fixed to a door frame of a wall in opposing relation with the at least one roll, wherein said roll abutment comprises a guide plane inclined in longitudinal and lateral directions in which the at least one roll leaves the roll abutment when the door is opened, thereby permitting the device to be embedded within one of an upper and a non-hinged side of the door with the roll partly exposed therefrom.

4. An earthquake-resistant device according to claim 3 wherein said device can be embedded and fixed to an upper corner end of the door and has a vertically rotating roll fixed to a lateral side and a horizontally rotating roll fixed to a longitudinal side.

5. An earthquake-resistant device according to claim 4 wherein said device is embedded and fixed to the upper lateral side of the door with the roll permitted to rotate vertically, and wherein said device is embedded and fixed to a non-hinged side of the door with the roll permitted to rotate horizontally.

6. An earthquake-resistant device according to claim 5 wherein said device is embedded and fixed to an upper corner end of the door with the roll permitted to rotate vertically, and wherein said device is embedded and fixed to the non-hinged side of the door at the intermediate position between the upper corner end and a position at which a door handle or mortise lock is fixed to the door, permitting the roll to rotate horizontally.

7. An earthquake-resistant device according to claim 3 wherein said device can be embedded and fixed to a non-hinged side of the door with the roll permitted to rotate horizontally.

* * * * *